US007261580B1

(12) United States Patent
Secora

(10) Patent No.: US 7,261,580 B1
(45) Date of Patent: Aug. 28, 2007

(54) CABLE CONNECTOR

(75) Inventor: Gary J. Secora, Menomonee Falls, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/412,303

(22) Filed: Apr. 27, 2006

(51) Int. Cl.
*H01R 13/627* (2006.01)

(52) U.S. Cl. ..... 439/341; 439/607

(58) Field of Classification Search ..... 439/341, 439/376, 909

See application file for complete search history.

(56) References Cited

U.S. PATENT DOCUMENTS 1,835,109 A * 12/1931 Ayres ..... 439/352
2,369,860 A * 2/1945 Schroeder ..... 439/289
5,273,462 A * 12/1993 Huser et al. ..... 439/681
5,408,059 A * 4/1995 Goble ..... 200/51 R
5,415,561 A * 5/1995 Mavrin et al. ..... 439/341
5,639,253 A * 6/1997 Rantanen ..... 439/341
6,488,530 B2 12/2002 Ohlsson
6,512,180 B2 1/2003 Nakagawa
6,565,264 B1 5/2003 Johnson et al.
6,582,252 B1 6/2003 Lin
6,607,402 B2 8/2003 Cohen et al.
6,629,928 B1 10/2003 Dolan et al.
6,635,019 B2 10/2003 Davidsen
6,638,100 B2 10/2003 Fogg et al.
6,659,955 B1 12/2003 Marian, Jr.
6,702,748 B1 3/2004 Nita et al.
6,722,898 B2 4/2004 Peloza et al.
6,739,197 B2 5/2004 Collins et al.
6,778,743 B1 8/2004 Kordahi et al.
6,780,154 B2 8/2004 Hunt et al.
6,786,762 B2 9/2004 Buck et al.
6,823,208 B2 11/2004 Ohlsson
6,910,906 B2 6/2005 Schorn
6,910,911 B2 * 6/2005 Mellott et al. ..... 439/358

(Continued)

FOREIGN PATENT DOCUMENTS

DE 3634695 * 4/1988

(Continued)

OTHER PUBLICATIONS

Proulx et al., "Advances in Catheter-Based Ultrasound Imaging", Intracardiac Echocardiography and the ACUSON AcuNav™ Ultrasound Catheter, undated (10 pp.).

(Continued)

*Primary Examiner*—Neil Abrams

(57) ABSTRACT

A cable connector assembly for connecting two cables, with each cable including multiple electrical conductors. The cable connector assembly may include a first enclosure having an outer surface and defining a pivot point, a plurality of externally accessible electrical connectors disposed at the outer surface of the first enclosure and configured to be coupled to the electrical conductors in one of the cables, a second enclosure configured to couple with the first enclosure about the pivot point in a mating configuration, and a plurality of electrical contacts disposed in the second enclosure. The contacts may be configured to releaseably receive one of the electrical connectors. The electrical connectors are configured in an outer array and an inner array on the circuit board. The outer array is coupled to a cable shield. The inner array is coupled to one of a data conductor and an electric power conductor.

16 Claims, 5 Drawing Sheets

U.S. PATENT DOCUMENTS

| | | | | |
|---|---|---|---|---|
| 6,923,768 | B2 | 8/2005 | Camus et al. | |
| 6,942,620 | B2 | 9/2005 | Nita et al. | |
| 6,942,677 | B2 | 9/2005 | Nita et al. | |
| 2005/0096554 | A1 * | 5/2005 | Dudik et al. | 600/500 |

FOREIGN PATENT DOCUMENTS

| | | | |
|---|---|---|---|
| GB | 2219445 | * | 12/1989 |

OTHER PUBLICATIONS

Siemens medical, "ACUSON AcuNav™ 8F Ultrasound Catheter", Ultrasound system and catheter specifications, available at least by May, 2005 (4 pp.).

Siemens medical, "ACUSON AcuNav 8F ultrasound catheter", Vision inside the heart, available at least by 2005 (4 pp.).

Siemens medical, "ACUSON AcuNav Diagnostic Ultrasound Catheter", Intracardiac Echocardiography Instructional Guide, available at least by 2003 (17 pp.).

* cited by examiner

CABLE CONNECTOR

FIELD OF THE INVENTION

The present invention relates generally to the field of cable connectors and specifically to cable connectors used as an interface with catheters.

BACKGROUND OF THE INVENTION

Catheters are well known for use in guiding and diagnostic procedures, for example in medical procedures. Catheters can be used to transport various tools, such as stents, filters, other implantable medical devices, sensing equipment, or imaging equipment. Catheters may be coupled to a machine, which processes data received from a catheter or controls a catheter, via a cable. Such a connection can be tedious to create and obtain and can also be a point where electrical interference is introduced into the system.

Thus there is a need for a cable connector that provides a quickly attachable and detachable yet secure mechanical connection between a cable and a catheter. There is also a need for a cable connector that provides a connection point outside of the sterile field of the catheter. There is also a need for a coupling system that is shielded throughout in order to prevent electrical interference. There is also a need for a method of connection a cable with a catheter in a quickly detachable manner that is shielded from electrical interference outside of the sterile field of the catheter.

SUMMARY OF THE INVENTION

One embodiment of the invention relates to a cable connector assembly for connecting two cables, with each cable including multiple electrical conductors. The connector assembly comprises a first enclosure having an outer surface and defining a pivot point, a plurality of externally accessible electrical connectors disposed at the outer surface of the first enclosure and configured to be coupled to the electrical conductors in one of the cables, a second enclosure configured to couple with the first enclosure about the pivot point in a mating configuration, and a plurality of electrical contacts disposed in the second enclosure. The electrical contacts are configured to releaseably receive one of the electrical connectors and are configured to be coupled to the electrical conductors in the other cable. A release latch is coupled to one of the first and second enclosure and configured to releaseably secure the first and second enclosure in the mating configuration. The two cables are connected when the first and second enclosure are in the mating configuration.

Another embodiment of the invention relates to an ultrasound imaging system. The imaging system comprises an ultrasound machine coupled to a first cable having multiple conductors, a catheter coupled to a second cable having multiple conductors; and a cable connector for connecting the two cables together. The connector assembly comprises a first enclosure having an outer surface defining a pivot point, a plurality of externally accessible electrical connectors disposed at the outer surface of the first enclosure and configured to be coupled to the electrical conductors in one of the cables, a second enclosure configured to couple with the first enclosure about the pivot point in a mating configuration, and a plurality of electrical contacts disposed in the second enclosure and configured to releaseably receive one of the electrical connectors, with the contacts configured to be coupled to the electrical conductors in the other cable.

A release latch is coupled to one of the first and second enclosure and configured to releaseably secure the first and second enclosure in the mating configuration. The two cables are connected when the first and second enclosure are in the mating configuration.

Another embodiment of the invention relates to a method for connecting two cables with each cable including multiple conductors and an enclosure structure, a first enclosure defining a recess and including a plurality of externally accessible electrical contacts coupled to the conductors in one of the cables, a second enclosure including a plurality of electrical contacts disposed in the enclosure and configured to reasonably receive one of the electrical contacts and coupled to the connectors in the other cable. The method comprises the steps of receiving a protrusion defined on the second enclosure into a cavity defined in the recess of the first enclosure, and pivoting the second enclosure about the protrusion until the first and second enclosure are in the same plane. The two cables are connected with the first and second enclosure in a mating configuration.

A method for connecting two cables, each cable including multiple conductors and an enclosure structure. A first enclosure including a plurality of externally accessible electrical contacts coupled to the conductors in the cable. A second enclosure including a plurality of electrical contacts disposed in the enclosure and configured to releaseably receive one of the electrical contacts in the first enclosure and coupled to the conductors in the cable. The method comprising inserting the one enclosure into a recess defined in the other enclosure with a portion of the first enclosure and a portion of the second enclosure, in combination, define a pivot point. Pivoting the inserted enclosure about the pivot point until both enclosures are in the same plane. The two cables are connected with both enclosures in a mating configuration

DETAILED DESCRIPTION OF THE EXEMPLARY EMBODIMENTS

Figure 1:
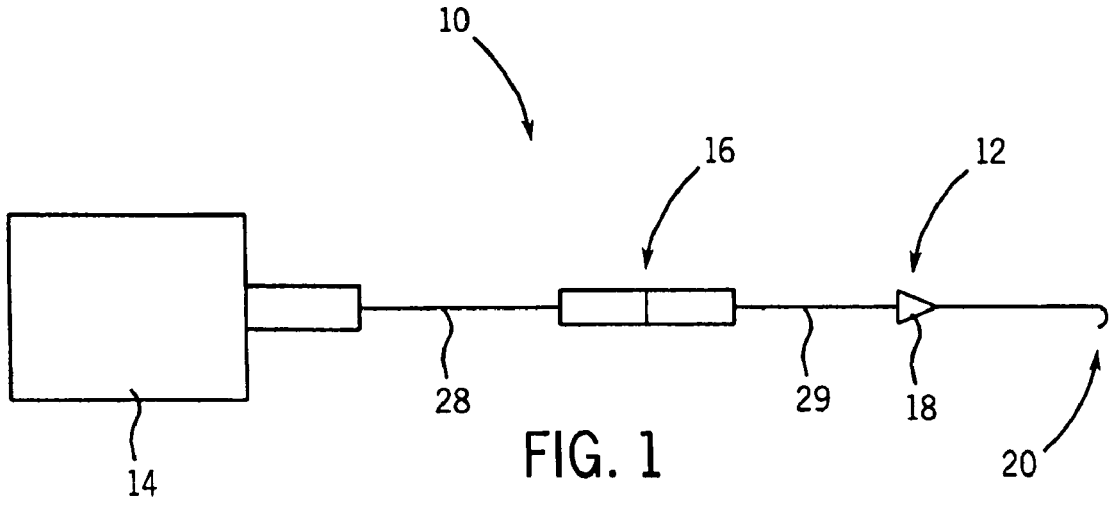
FIG. 1 is a schematic view of a catheter system with a cable connector coupling a catheter to a computer processing means according to one example embodiment.

Referring to FIG. 1, a catheter system 10 may be configured to obtain data from a subject of interest or to perform a procedure within the subject of interest. In one example embodiment, the subject of interest may be a heart where catheter system 10 is an intra-cardiac catheter system used to retrieve data from inside the heart. In another example embodiment, catheter system 10 may be an ultrasound imaging system with an ultrasound machine where ultrasound data is retrieved from inside a subject of interest such as a human body. In other example embodiments, the subject of interest may be any other suitable subject that catheter system 10 may obtain data from.

Catheter system 10 generally includes a catheter 12, a computer processing means 14, and a cable connector 16. Catheter 12 is the portion of catheter system 10 that may be controlled by a user via a handle 18 with at least a tip 20 actually placed within the body of interest. Catheter 12 may be of past, present, or future design that is capable of retrieving data.

Computer processing means 14 may include a visual display and is configured to process data that may be received from catheter 12 of a subject of interest. In one example embodiment, computer processing means 14 may be an ultrasound machine that displays ultrasound images based on data retrieved from catheter 12. In another example embodiment, computer processing means 14 may be an infrared imaging machine that displays infrared images based on data retrieved from catheter 12. In still other embodiments, computer processing machine may be any other type of processing machine that may display any other type of data received from catheter 12 such as temperature or pressure information.

Cable connector 16 is configured to couple cables extending from catheter 12 and computer processing means 14. Cable connector 16 may be configured to both attach the cables in order to complete an electrical connection and detach the cables in order to break the electrical connection. Cable connector 16 is intended to provide a connection point between catheter 12 and computer processing means 14 outside the sterile field that catheter 12 is used in so that someone coupling or decoupling catheter 12 and computer processing means 14 does not have to be sterile. In one example embodiment, the cables extending from catheter 12 and computer processing means 14 may be permanently attached to catheter 12 or computer processing means 14. In another example embodiment, the cables extending from catheter 12 and computer processing means 14 may be detachable from catheter 12 or computer processing means 14.

Figure 2:
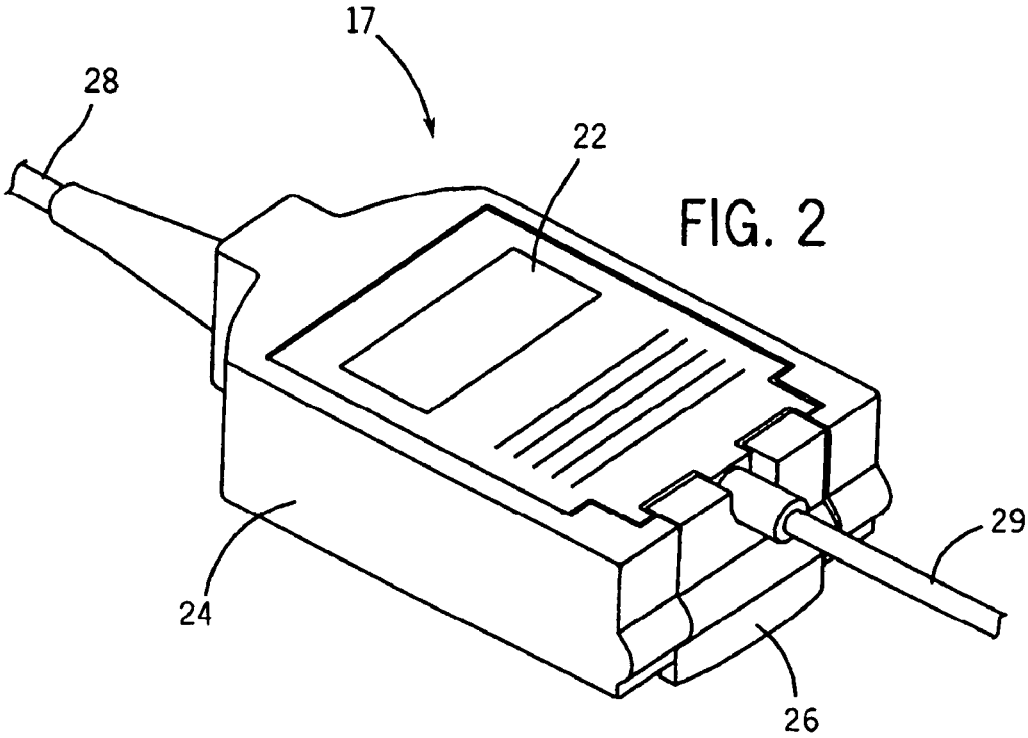
FIG. 2 is a perspective view of a cable connector of according to one example embodiment.

Referring to FIG. 2, a cable connector assembly 17 is illustrated, which is an example embodiment of cable connector 16 shown in FIG. 1. Cable connector assembly 17 generally includes an enclosure 24 (sometimes referred to as a first enclosures), an enclosure 22 (sometimes referred to as a second enclosure), and a release latch 26. Enclosure 24 may be configured to receive enclosure 22. Enclosure 22 may be retained within enclosure 24 by release latch 26, which applies pressure biasing enclosures 22 and 24 towards one another in a mating configuration and thus coupling cable 28 to cable 29. In another example embodiment, enclosure 24 may be configured to receive enclosure 22. In other example embodiments, enclosure 22 or 24 may not receive the other enclosure, but enclosures 22 and 24 may be secured together in another manner such as with multiple release latches. In another embodiments where one of enclosures 22 and 24 receives the other, release latch 26 may be omitted with enclosures 22 and 24 retaining each other by other means. In still other example embodiments, more than one release latch may be used to retain enclosure 24 within enclosure 22. In various example embodiments, enclosures 22 and 24 may be made of any suitable material for coupling cables together such as a plastic or insulated metal.

Figure 3:
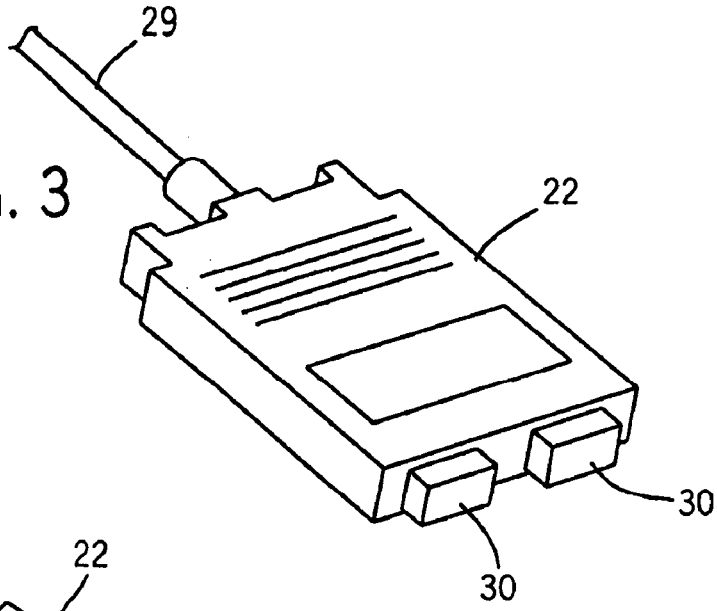
FIG. 3 is a perspective view of a second enclosure of the cable connector of FIG. 2 according to one example embodiment.
Figure 4:
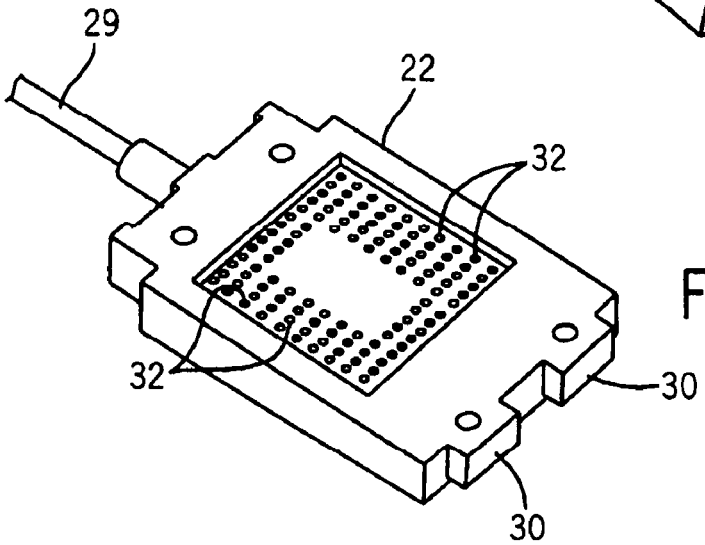
FIG. 4 is a perspective view of the underside of the enclosure of FIG. 3 according to one example embodiment.
Figure 5:
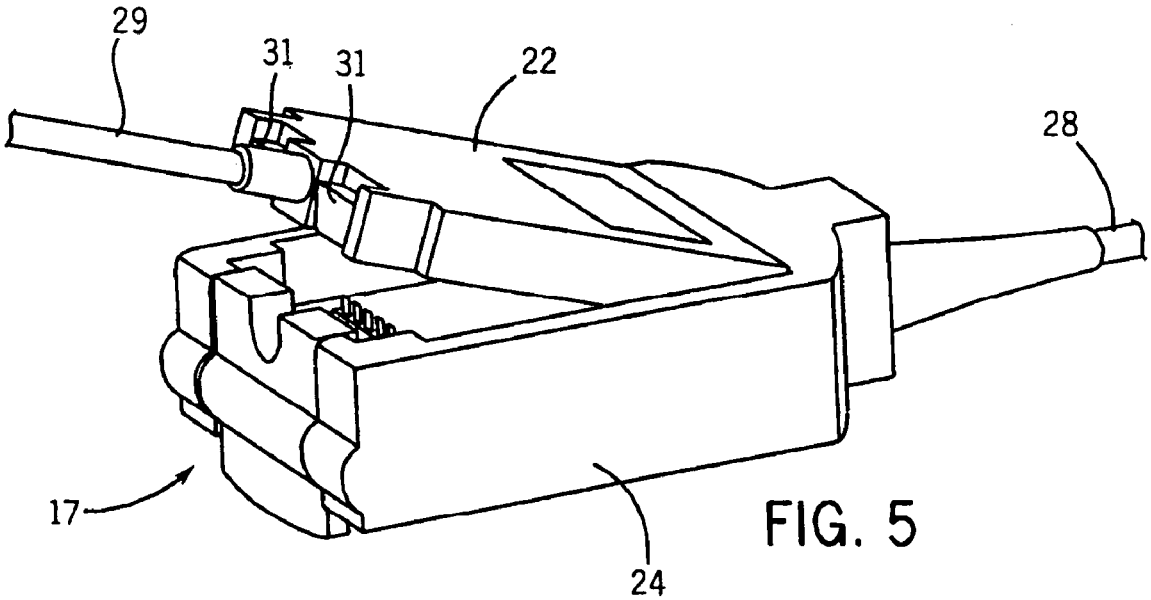
FIG. 5 is a perspective view of the second enclosure of FIG. 3 being inserted into a first enclosure of the cable connector of FIG. 2 according to one example embodiment.

Referring to FIGS. 3-5, a more detailed illustration of enclosure 22 is shown and how it is placed within enclosure 24. Enclosure 22 generally includes a protrusion defining a pivot point, for example a peg, 30 and a ramp portion 31 and defines contacts or holes 32. Protrusion 30 is configured to mate with enclosure 24 about the pivot point while release latch 26 biases against ramp portion 31 in order to retain enclosure 22 within enclosure 24. Ramp portion 31 may have a wedge or curved shape with a generally flat top, so that release latch 26 is rotated out as enclosure 22 is inserted in a mating configuration into enclosure 24 and when completely inserted, release latch 26 rotates back in over the flat portion. Thus enclosure 22 is retained within enclosure 24 until the release latch is rotated back away from ramp portion 31. While the illustrated example embodiment shows that two protrusions and two ramp portions are used, it is noted that in other example embodiments more or fewer than two protrusions or ramp portions may be used to aid in retention of enclosure 22.

Contacts or holes 32 provide an access point for connectors or contacts 34 to couple with contacts 46 (FIG. 7) within enclosure 24. Connectors 34 may be spring-loaded to account for misalignment when inserting enclosure 22 into enclosure 24. In another example embodiment, connectors 34 may be fixed. In various example embodiments connectors 34 and holes 32 may be of any appropriate shape, size, or number that facilitates the coupling of each desired wire in enclosures 22 and 24. In other example embodiments holes 32 may be omitted with the connectors and contacts being of any suitable configuration to couple together. In still other example embodiments, connectors 34 may be included in enclosure 24 and contacts 46 may be included in enclosure 22.

Figure 6:
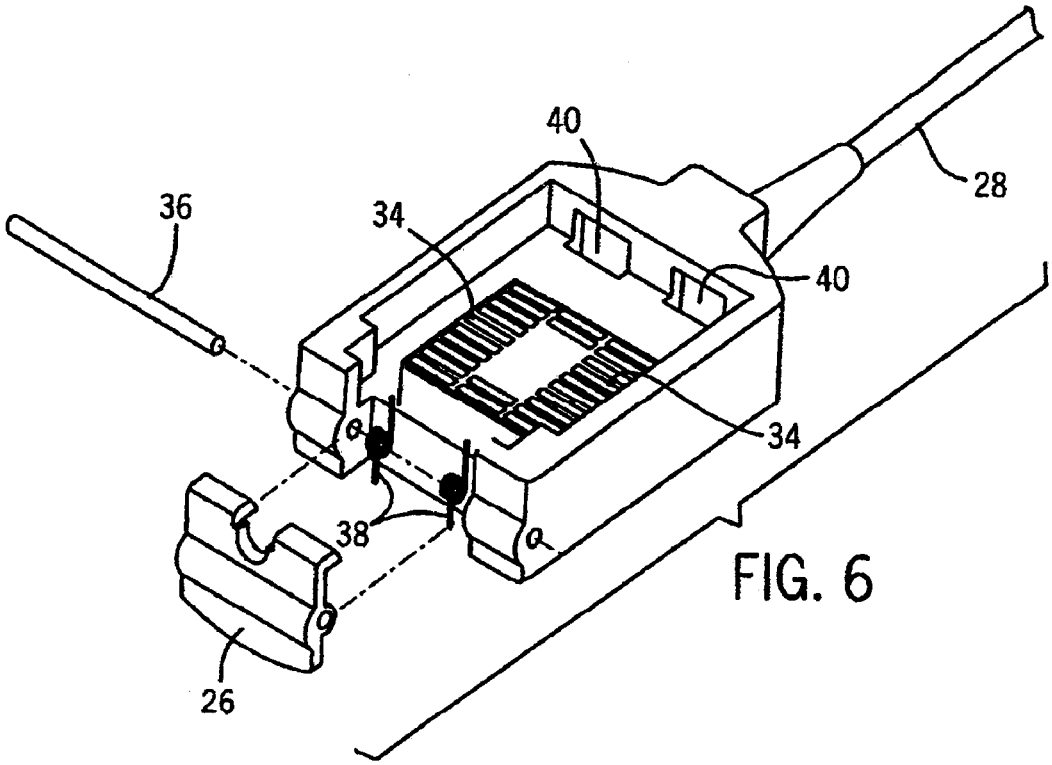
FIG. 6 is a partially exploded perspective view of the first enclosure of the cable connector of FIG. 2 according to one example embodiment.

Referring to FIG. 6, enclosure 24 is shown in greater detail. Enclosure 24 includes pin 36, springs 38, and defines receptacles 40. Pin 36 serves to attach release latch 26 to enclosure 24 and as an axis for release latch 26 to rotate around. In other example embodiments pin 36 may be omitted with release latch 26 integrally formed with enclosure 24 and rotatable by a hinge. Springs 38 provide a bias against release latch 26 so that when the bottom portion of release latch 26 is pressed and released the release latch moves back to an upright position. Pressing the bottom portion of release latch 26 allows enclosure 22 to be removed from or inserted into enclosure 24 while release of release latch 26 allows inserted enclosure 22 to be retained. In other example embodiments there may be more or fewer than the two springs in the illustrated example embodiment. A receptacle or recess 40 is configured to receive protrusion 30 from enclosure 22 and act as a guide and a pivot point and as another retention point for coupling of enclosures 22 and 24 in a mating configuration. In another embodiment, a protrusion defined in the enclosure 22 is configured for insertion into a receptacle 40 defined in enclosure 24, creating a pivot point. The illustrated example embodiment shows that connectors 34 are arranged in a rectangular manner, but in other example embodiments, another configuration may be used.

Figure 7:
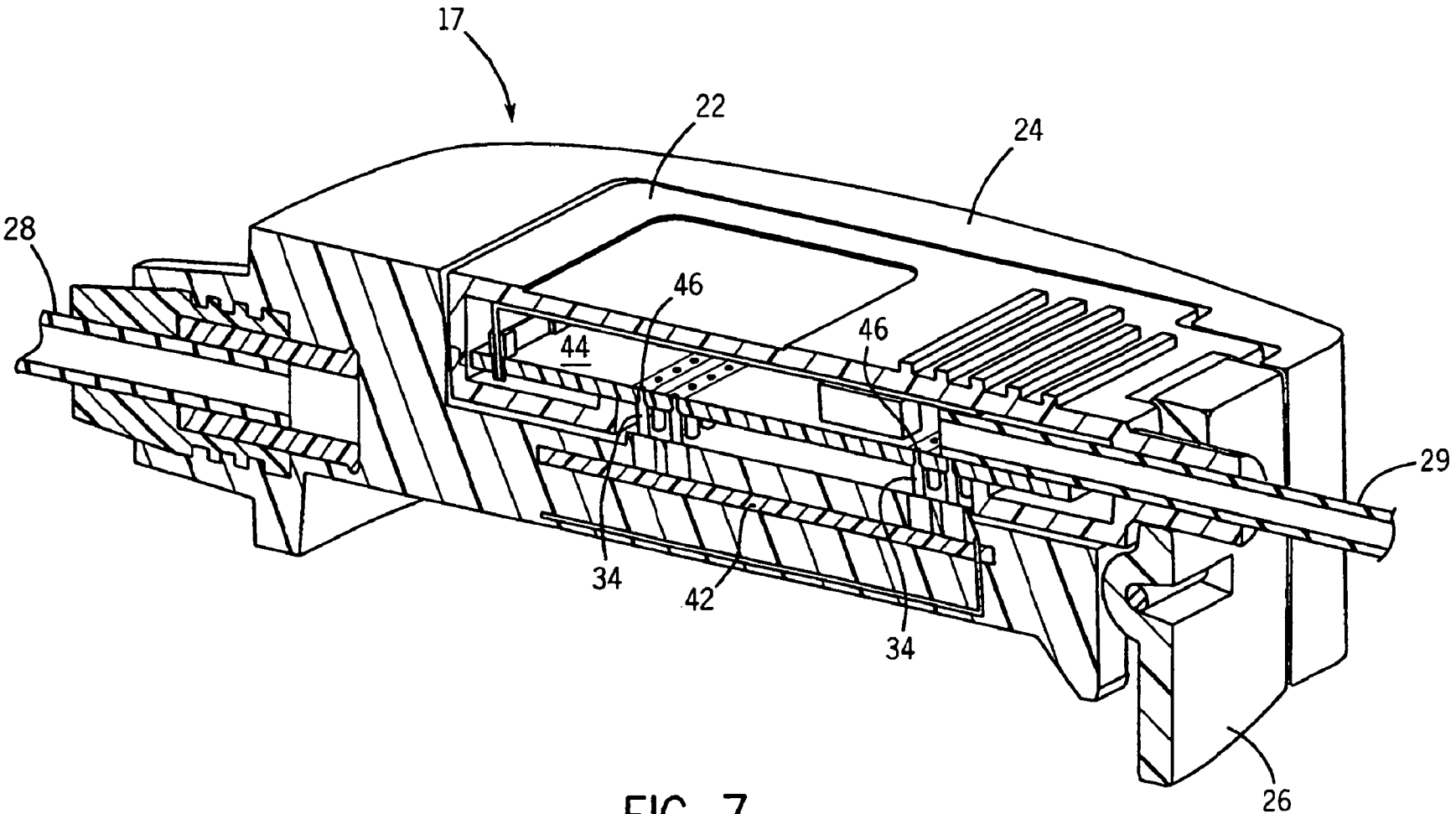
FIG. 7 is a perspective cross-sectional view of the cable connector of FIG. 2 according to one example embodiment.

Referring to FIG. 7, each enclosure 22 and 24 may include a printed circuit board (PCB) 42 and 44, respectively. Cable 28 may be coupled to PCB 42 while cable 29 may be coupled to PCB 44. Connectors 34 are attached to PCB 42 of enclosure 22 and couple with contacts 46 through holes 32 of enclosure 24. In one example embodiment, contacts 46 or connectors 34 may be composed of gold. In other example embodiments, contacts 46 or connectors 34 may be composed of any other conductor such as copper or silver. In still other example embodiments, PCBs may not used but contacts 46 and connectors 34 may be coupled to the cables being connected via wires or other connection media.

Figure 8:
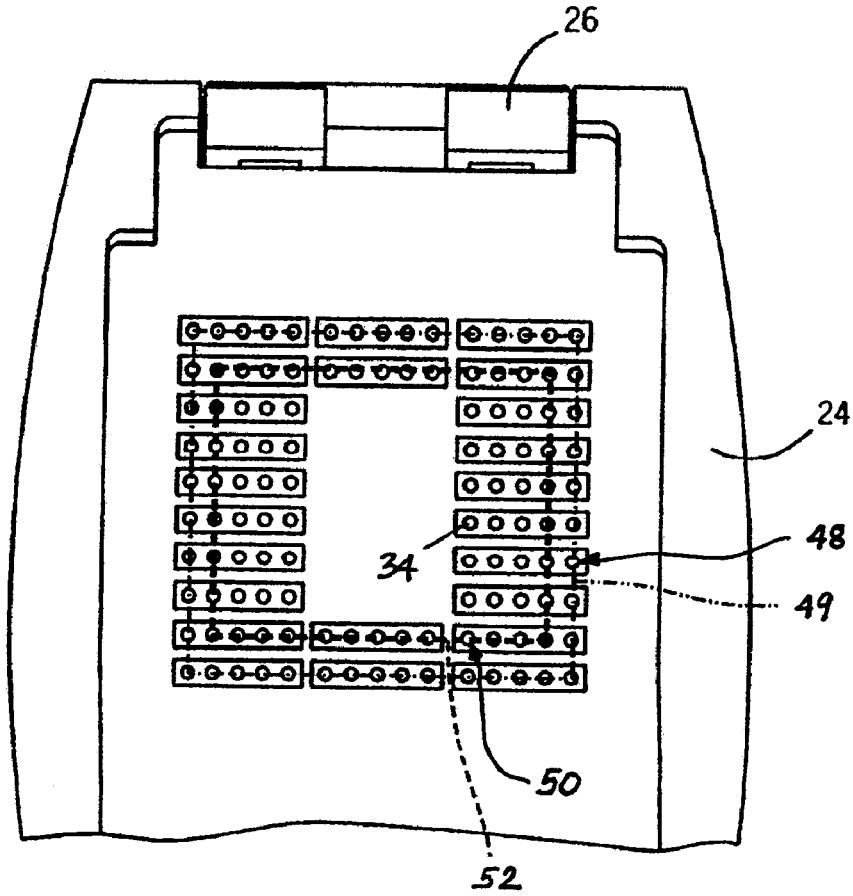
FIG. 8 is a top view of the first enclosure of the cable connector of FIG. 2 according to one example embodiment.

Referring to FIG. 8, connectors 34 may be in a configuration where an outer array 48 (located along first dashed line and reference 49) of connectors 34 is coupled to a cable shield (represented by dashed line and reference 49), and with an inner array 50 (located along second dashed line and reference 52) of connectors 34 comprising a set of data conductors or power conductors. Outer array 48 of connectors 34 is intended to act as a reference point for inner array 50 of connectors 34 to create an electrical field. This electric field is intended to effectively cancel outside electrical and magnetic forces so that the integrity of the data or power being transmitted by inner array 50 of connectors 34 is increased. While the illustrated example embodiment shows outer array 48 comprising only the outermost connectors 34 with inner array 50 comprising the other connectors 34, in other example embodiments, outer array 48 of connectors 34 may include more or fewer connectors 34 around the perimeter of inner array 50 of connectors 34.

Although cable connector 16 is illustrated as including multiple features utilized in conjunction with one another, cable connector 16 may alternatively utilize less than all of the noted mechanisms or features. For example, in other embodiments, release latch 26 may be a permanent attachment to enclosure 22. In still other embodiments, springs 38 may be omitted with release latch 26 snapping into one of the enclosures 22 or 24.

Figure 9:
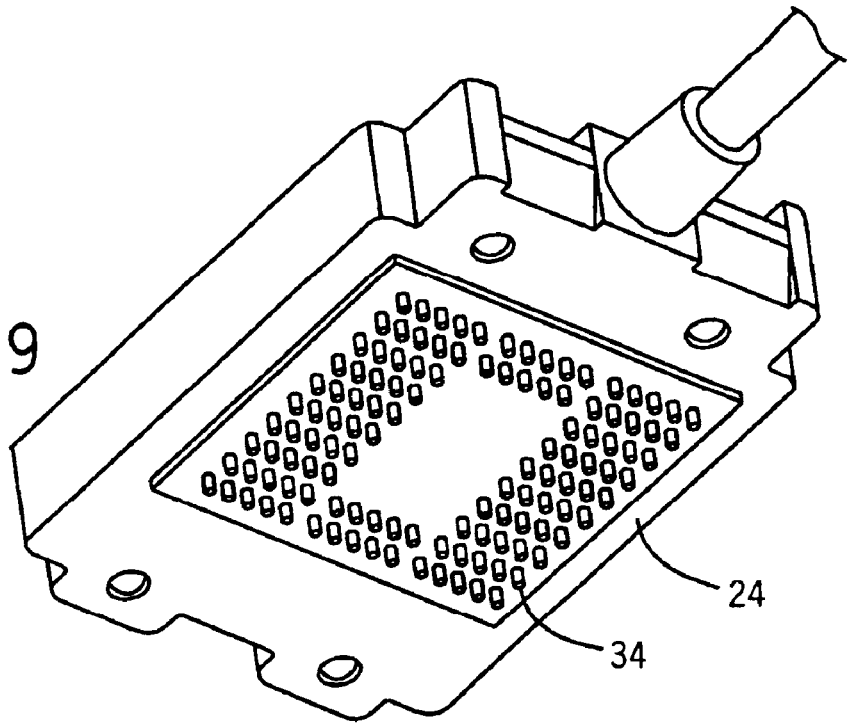
FIG. 9 is a perspective view of an exemplary embodiment of the second enclosure including a plurality of protruding connectors.
Figure 10:
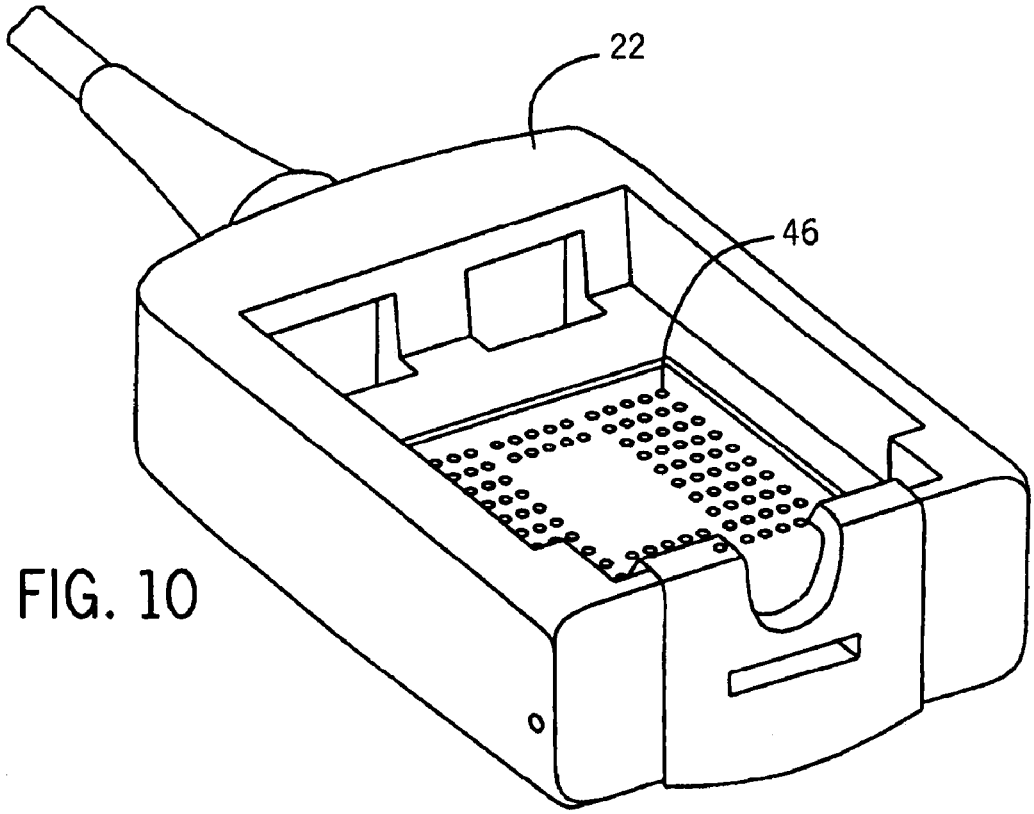
FIG. 10 is a perspective view of an exemplary embodiment of the first enclosure including a plurality of contacts configured to receive the protruding connectors illustrated in FIG. 9.

Referring to FIGS. 9-10, a detailed illustration of enclosures 22 and 24 are shown according to another example embodiment. In this embodiment, connectors 34 are included in enclosure 24 with holes 32 defined by and contacts 46 included in enclosure 22. The remaining portions of enclosures 22 and 24 may be substantially similar to the previously described example embodiments. Thus when enclosure 24 is inserted into enclosure 22, the protruding connectors 34 are inserted into holes 32 (now in enclosure 22) and couple with contacts 46 (also now in enclosure 22).

Although specific shapes of each element have been set forth in the drawings, each element may be of any other shape that facilitates the function to be performed by that element. For example, connectors 34 are shown to define a rectangular area, however, in other embodiments the structure may define that of a relatively circular form.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature The present disclosure has been described with reference to example embodiments, however workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

It is also important to note that the construction and arrangement of the elements of the system as shown in the preferred and other exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the preferred and other exemplary embodiments without departing from the spirit of the present subject matter.

What is claimed is:

1. A cable connector assembly for connecting two cables, with each cable including multiple electrical conductors, the connector assembly comprising:

a first enclosure having an outer surface and defining a pivot point;

a plurality of externally accessible electrical connectors disposed at the outer surface of the first enclosure and configured to be coupled to the electrical conductors in one of the cables;

a circuit board configured to support the plurality of electrical connectors;

a second enclosure configured to couple with the first enclosure about the pivot point in a mating configuration;

a plurality of electrical contacts disposed in the second enclosure and configured to releaseably receive one of the electrical connectors, with the contacts configured to be coupled to the electrical conductors in the other cable; and a release latch coupled to one of the first and second enclosure and configured to releaseably secure the first and second enclosure in the mating configuration, wherein the two cables are connected when the first and second enclosure are in the mating configuration, wherein the electrical connectors are configured in an outer array and an inner array on the circuit board, with the outer array coupled to a cable shield and the inner array coupled to one of a data conductor and an electric power conductor.

2. The cable connector assembly of claim 1, including second circuit board configured to support the electrical contacts.

3. The cable connector assembly of claim 1, wherein the electrical contacts are configured in an outer array and an inner array on the second circuit board, with the outer array coupled to a cable shield and the inner array coupled to one of a data conductor and an electric power conductor.

4. The cable connector assembly of claim 1, wherein the second enclosure includes a ramp portion configured to displace the release latch as the second enclosure is mated to the first enclosure.

5. The cable connector assembly of claim 1, wherein the electrical connectors are spring-loaded.

6. An ultrasound imaging system comprising:

an ultrasound machine coupled to a first cable having multiple conductors;

a catheter coupled to a second cable having multiple conductors; and a cable connector assembly for connecting the two cables together, the connector assembly comprising:

a first enclosure having an outer surface and defining a pivot point;

a plurality of externally accessible electrical connectors disposed at the outer surface of the first enclosure and configured to be coupled to the electrical conductors in one of the cables;

a circuit board configured to support the plurality of electrical connectors;

a second enclosure configured to couple with the first enclosure about the pivot point in a mating configuration;

a plurality of electrical contacts disposed in the second enclosure and configured to releaseably receive one of the electrical connectors, with the contacts configured to be coupled to the electrical conductors in the other cable; and a release latch coupled to one of the first and second enclosure and configured to releaseably secure the first and second enclosure in the mating configuration, wherein the two cables are connected when the first and second enclosure are in the mating configuration, and wherein the electrical connectors are configured in an outer array and an inner array on the circuit board, with the outer array coupled to a cable shield and the inner array coupled to one of a data conductor and an electric power conductor.

7. The ultrasound imaging system of claim 6, including second circuit board configured to support the electrical contacts.

8. The ultrasound imaging system of claim 6, wherein the electrical contacts are configured in an outer array and an inner array on the second circuit board, with the outer array coupled to a cable shield and the inner array coupled to one of a data conductor and an electric power conductor.

9. The ultrasound imaging system of claim 6, wherein the second enclosure includes a ramp portion configured to displace the release latch as the second enclosure is mated to the first enclosure.

10. The ultrasound imaging system of claim 6, wherein the electrical connectors are spring-loaded.

11. A cable connector assembly for connecting two cables, with each cable including multiple electrical conductors, the connector assembly comprising:

a first enclosure having an outer surface;

a plurality of externally accessible electrical connectors disposed at the outer surface of the first enclosure and configured to be coupled to the electrical conductors in one of the cables;

a circuit board configured to support one of the plurality of electrical connectors or plurality of electrical contacts;

a second enclosure configured to couple with the first enclosure in a mating configuration; and a plurality of electrical contacts disposed in the second enclosure and configured to releaseably receive one of the electrical connectors, with the contacts configured to be coupled to the electrical conductors in the other cable;

wherein the two cables are connected when the first and second enclosure are in the mating configuration, and wherein the one of the plurality of the electrical connectors and plurality of electrical contacts are configured in an outer array and an inner array on the circuit board, with the outer array coupled to a cable shield and the inner array coupled to one of a data conductor and an electric power conductor.

12. The cable connector assembly of claim 11, further comprising:

a release latch coupled to one of the first and second enclosure and configured to releaseably secure the first and second enclosure in the mating configuration.

13. The cable connector assembly of claim 12, wherein the second enclosure includes a ramp portion configured to displace the release latch as the second enclosure is mated to the first enclosure.

14. The cable connector assembly of claim 11, wherein one of the first and second enclosures includes a pivot point configured to couple with the other of the first and second enclosures in the mating configuration.

15. The cable connector assembly of claim 11, further comprising a second circuit board configured to support the other of the plurality of electrical connectors and the plurality of electrical contacts.

16. The cable connector assembly of claim 15, wherein the other of the electrical connectors and plurality of electrical contacts are configured in an outer array and an inner array on the second circuit board, with the outer array coupled to a cable shield and the inner array coupled to one of a data conductor and an electric power conductor.

* * * * *